US007784999B1

(12) United States Patent
Lott

(10) Patent No.: US 7,784,999 B1
(45) Date of Patent: Aug. 31, 2010

(54) EDUCTOR APPARATUS WITH LOBES FOR OPTIMIZING FLOW PATTERNS

(75) Inventor: Gerald Lott, Houston, TX (US)

(73) Assignee: Vortex Systems (International) CI, Houston, TX (US)

( * ) Notice: Subject to any disclaimer, the term of this patent is extended or adjusted under 35 U.S.C. 154(b) by 0 days.

(21) Appl. No.: 12/496,489

(22) Filed: Jul. 1, 2009

(51) Int. Cl.
*B01F 5/04* (2006.01)

(52) U.S. Cl. ..... 366/163.2; 137/888

(58) Field of Classification Search ..... 366/181.5, 366/163.2, 173.1, 175.2, 182.4, 174.1, 181.8, 366/163.1, 167.1, 176.1, 337; 137/888–896
See application file for complete search history.

(56) References Cited

U.S. PATENT DOCUMENTS

| | | | | | |
|---|---|---|---|---|---|
| 501,569 | A * | 7/1893 | Laux | 137/890 |
| 2,361,150 | A * | 10/1944 | Petroe | 162/66 |
| 3,304,564 | A * | 2/1967 | Green et al. | 15/1.7 |
| 3,643,688 | A * | 2/1972 | Meinert | 137/556 |
| 3,799,195 | A * | 3/1974 | Hermans | 137/553 |
| 3,819,157 | A * | 6/1974 | Markfelt | 366/101 |
| 4,673,006 | A * | 6/1987 | Speck | 141/1 |
| 4,673,335 | A * | 6/1987 | Nicodemus | 417/54 |
| 5,275,486 | A * | 1/1994 | Fissenko | 366/178.3 |
| 5,779,355 | A * | 7/1998 | Pullman | 366/137 |
| 5,863,128 | A * | 1/1999 | Mazzei | 366/163.2 |
| 5,951,922 | A * | 9/1999 | Mazzei | 261/36.1 |
| 6,427,724 | B2 * | 8/2002 | Hua | 137/888 |
| 6,523,991 | B1 * | 2/2003 | Maklad | 366/163.2 |
| 6,969,052 | B2 * | 11/2005 | Korzeniowski | 261/76 |
| 2004/0094848 | A1 * | 5/2004 | Lange | 261/59 |

FOREIGN PATENT DOCUMENTS

| | | | |
|---|---|---|---|
| EP | 50312 | A2 * | 4/1982 |
| EP | 282061 | A2 * | 9/1988 |

* cited by examiner

*Primary Examiner*—Charles E Cooley
(74) *Attorney, Agent, or Firm*—Egbert Law Offices PLLC

(57) ABSTRACT

An eductor apparatus has an inlet nozzle section with a primary inlet and a nozzle, a mixing chamber connected to the inlet nozzle section and in fluid communication with a narrow diameter opening of the nozzle, and a diffuser section connected to the mixing chamber opposite the inlet nozzle section. The diffuser section has throat formed therein. The throat has a plurality of lobes formed thereon. The plurality of lobes extend longitudinally along the throat. The lobes are generally equally circumferentially spaced from each other around the throat. The narrow diameter opening of the nozzle has another plurality of lobes formed therearound and extending in longitudinally alignment with the plurality of lobes of the throat.

16 Claims, 2 Drawing Sheets

EDUCTOR APPARATUS WITH LOBES FOR OPTIMIZING FLOW PATTERNS

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The present invention relates to eductor apparatus. More particularly, the present invention the relates to eductor apparatus whereby a first fluid is mixed with a secondary solid or liquid through the use of a venturi. More particularly, the present invention relates to eductor apparatus whereby lobes are formed on a throat of a diffuser so as to minimize boundary layer formation in the diffuser.

2. Description of Related Art Including Information Disclosed Under 37 CFR 1.97 and 37 CFR 1.98

Eductors and jet pumps are designed so as to utilize the Bernoulli principle of when pressure is high, velocity is low and inversely when velocity is high, pressure is low. The term "eductor" or jet pump describes a pump with no moving parts that converts pump pressure into a high-velocity stream (kinetic energy) in order to generate a low pressure. The resulting high-velocity stream produces a low pressure region that draws in and entrains a secondary powder or liquid through the suction inlet (induction port). At the intersection of the issuing motive liquid stream emanating from the nozzle orifice and the secondary additive entering the mixing chamber from the suction inlet, an exchange of momentum produces a mixed stream traveling at a velocity intermediate to the motive fluid and suction velocity. The downstream diffuser section then converts the velocity-pressure back into static pressure at the discharge of the eductor. In addition to mixing a secondary powder or liquid with a motive liquid, these devices are used to convey, compress and mix gases and vapors.

Many eductor and jet pump designs incorporate tabs, skewed swirls and other downstream attachments in the diffuser section to attempt to generate more intense turbulence, thereby attempting to aid to enhance mixing a primary motive fluid with a secondary additive. These obstructions disturb the streamline flow pattern, causing "eddies" and waves that require considerable energy to support them. This energy is drawn from the primary flow-field (bulk fluid stream), thus reducing the energy level in the flow-field and ultimately reducing the diffuser efficiency. These structure formations may cause the boundary layer to prematurely detach from the pipe wall surface. Relatively larger particles will not follow the bulk liquid flow and will collide and collect on any obstacle in the downstream flow-field.

Generally, eductors and jet pumps are described with three components: (1) a nozzle; (2) an induction port (suction); and (3) a diffuser assembled in a housing. However, two of the most important and functional components of an eductor and jet pump are sometimes overlooked. In particular, these are the mixing chamber and the Venturi throat section. The mixing chamber is located between the nozzle orifice discharge and the converging inlet into the Venturi throat. This is the intersecting, comingling and interacting region between the motive fluid and the secondary additive that has been introduced through the induction port (suction). The first stage of mixing occurs in the mixing chamber and the final stage of mixing occurs in the Venturi throat before entering the downstream diffuser section.

The motive nozzle should be designed to produce the highest possible velocity relative to the input energy. The downstream cross-sectional Venturi throat should be designed to provide the strongest suction possible before the fluid enters the diffusion section. The diffuser should be designed to provide the greatest amount of energy recovery during conversion.

The diffuser section of the eductor or jet pump is a diverging duct that is shaped to gradually recover fluid static pressure from a fluid stream while reducing the downstream flow velocity. It is a means of converting kinetic energy into static pressure. During velocity deceleration and the increase in static pressure, it must be noted that if the diffuser angle of discharge is greater than ten degrees, fluid separation from the conduit wall may occur. In many technical articles, the diffuser discharge angle is recommended between seven and twelve degrees. Any higher angle than twelve degrees may cause separation. The diffuser is a pressure recovery tube that is shaped to gradually reduce the velocity and convert the energy into static pressure at the discharge with as little pressure loss as possible.

A key to an efficient and effective diffuser is one that lies in the ability to control the downstream boundary layer and delay detachment. When a flowing fluid stream comes in contact with a stationary surface, a portion of the free-flowing stream velocity is reduced. The free-flowing stream velocity reduction is caused by shear stress between the stationary conduit wall and the moving fluid stream. This frictional flow resistance is known as frictional or viscous drag. A thin layer of fluid adjacent to the conduit or pipe wall surface increases from zero to a mean velocity of the free-flowing stream. The viscous layer near the conduit wall is called the boundary layer. The boundary layer fluid gradually blends into the free-flowing stream.

Diffuser "stall" is the detachment or separation of flow from the diffuser internal surface walls during fluid deceleration causing the formation of "eddies" and a region of unsteady flow within the diffuser. The profile of flow exiting from the diffuser and the diffuser pressure recovery are intimately related to the possibility of diffuser stall. Downstream tendency to wall detachment that leads to diffuser stall can block the diffusion flow causing an unsteady and unstable exit flow that may result in a significant loss of pressure and, if the loss is great enough, a reversal of flow can occur.

Diffuser performance is largely governed by the growth of the boundary layer and the degree to which the flow conforms to the diffuser internal surface walls. An efficient diffuser is one which converts the highest possible percentage of kinetic energy into pressure within a given restriction in diffuser length and expansion ratio (i.e. aspect ratio). The intensity of the flow-field velocity is determined by the motive feed pressure (Reynolds number), the total mass content of the admixture, the mixture density and downstream viscous drag.

FIG. 1 is an illustration of prior art eductor assembly. As can be seen, the eductor assembly 10 in FIG. 1 has an inlet nozzle section 12, a mixing chamber 14 and a diffuser section 16. The inlet nozzle section 12 has a tubular portion 18 that extends to a nozzle 20. The tubular portion 18 defines a primary inlet 22. The primary inlet 22 carries a fluid to the nozzle 20. The nozzle 20 has a wide diameter portion 24 opening to the primary inlet 22 and a narrow diameter opening 26 opening to the mixing chamber 14. The narrow diameter opening 26 is adjacent an end of the nozzle 20 opposite the wide diameter opening 24.

In FIG. 1, it can be seen that the mixing chamber 14 is connected to the inlet nozzle section 12 and is in fluid communication with the narrow diameter opening 26 of the nozzle 20. The mixing chamber 14 has an induction port 28 opening thereto and extending therefrom. In particular, it can be seen that the nozzle 20 has an outer surface 30 that extends greatly into the interior of the mixing chamber 14 and generally flows inwardly of the wall 32 of the induction port 28. As such, the outer surface 30 of the nozzle 20 provides a surface whereby any solids that are introduced into the induction port 28 can accumulate thereon.

The diffuser section 16 has a secondary inlet 24 with a wide diameter end 36 adjacent the mixing chamber 14 and a narrow diameter end 38 formed inwardly thereof. The secondary inlet 34 is the Venturi of the eductor apparatus. A diffuser 40 is connected by a throat 42 to the secondary inlet 34. The throat 42 is of a generally constant diameter. The diffuser 40 has a narrow diameter end 44 at the throat 42 and a wide diameter end 46 at the end 48 of the diffuser 16.

In the past, various patents have issued relating to such eductor apparatus. In particular, U.S. Pat. No. 5,664,733, issued on Sep. 9, 1997 to the present inventor, describes a fluid mixing nozzle and method. In this patent, a first fluid flows therefrom to mix with a second fluid external to the nozzle so as to induce vortex creation and chaotic turbulent flow. The nozzle has a body with a cavity extending therethrough from the inlet end to the outlet end. The cross-sectional area of the inlet orifice of the nozzle is greater than its outlet orifice cross-sectional area. The outlet orifice cross-section area shape has a substantially circular central portion and at least one protrusion extending from the perimeter of the central portion. The protrusions are smaller in cross-sectional area than the central portion and are equally spaced about the central portion perimeter.

U.S. Pat. No. 5,775,446, issued on Jul. 7, 1998 to the present inventor, teaches a nozzle insert for rotary rock bit that has an orifice with a generally circular central region and a plurality of angularly-spaced, non-circular outer regions around the periphery thereof so that flow of mud through each outer region develops a vortex pattern that increases entrainment of rock particles so as to prevent bit balling. It also serves to decreases overbalance pressure to enhance rate of penetration.

U.S. Pat. No. 6,609,638, issued on Aug. 26, 2003 to the present inventor describes a flow promoter that is used to promote flow of material in a hopper or bin container. The flow promoter comprises a body having an inlet orifice, an outlet orifice, and an arrangement of peaks, ridges, slopes and radial lobes provided at the inlet end to cooperatively create stress points in the material. This invention can also include a removable flow promoter that can be inserted into a container.

U.S. Pat. No. 6,796,704, issued on Sep. 28, 2004 to the present inventor, describes an apparatus and method for mixing components with a venturi. This eductor mixing device has a main body or housing of a generally cylindrical shape. An inner tube for one component to be mixed with a liquid is mounted in the main body with a vortex chamber formed in an annulus between the main body and the inlet flow tube. Pressurized liquid enters the vortex chamber through a generally rectangular entrance opening along an arcuate surface which smoothly merges with the cylindrical surface of the main body. A liquid in a swirling motion moves in a descending helical path about the inner tube and passes through a gap between coaxial frusto-conical surfaces of the converging inner nozzle of the inner tube and an outer coaxial liquid nozzle of the diffuser ring. A high velocity is created by the swirling liquid for exerting a suction or negative pressure at the lower end of the inner nozzle so as to draw the component to be mixed into the swirling liquid stream where the swirling liquid and particulate material form a strong vortex to create a slurry in a minimal travel distance after passing the inner converging nozzle of particulate inner tube.

U.S. Pat. No. 6,024,874, issued on Feb. 15, 2000 to the present inventor, shows a hydrocyclone separator. This hydrocyclone separator has an outer housing having an upper housing portion and a lower housing portion. The upper housing portion has a cylindrical chamber and an involuted entrance to the cylindrical chamber. The vortex finder tube has a flaring lower end portion. A solid core is mounted within the finder tube and extends downwardly from the finder tube a distance equal to one and a half times the inner diameter of the entrance orifice of the finder tube.

U.S. Pat. No. 6,000,839, issued on Dec. 14, 1999 to the present inventor, provides a continuous static mixing apparatus that includes mixing disks. Each of the mixing disks has a set of symmetrically distributed nozzles therein that accelerate the flow and that create mixing turbulence in the flow. Typically, the mixing apparatus combines the outlet flows of the mixing disks to provide a collision therebetween and, thus, increase turbulence and mixing. Communication passageways connect the material supplies to the mixing apparatus and direct the materials through the mixing disks.

U.S. Pat. No. 5,322,222 issued on Jun. 21, 1994 to the present inventor, teaches a spiral jet fluid mixer for mixing fluids. This spiral jet mixer has an elongated body with a first inlet nozzle for introduction of a primary fluid. A mixing chamber is provided having a diverging wall and a converging wall. A plurality of angled, helical passageways in the diverging wall allows the introduction of a secondary fluid into the mixing chamber in a spiraling turbulent, initially convergent flow pattern.

U.S. Pat. No. 4,971,768 issued on Nov. 20, 1990 to Ealba et al., shows a diffuser with convoluted vortex generator. A thin, convoluted wall member disposed upstream of the inlet of a diffuser so as to generate large-scale vortices having axes in the downstream direction. The vortices enhance mixing within the diffuser and can also energize the boundary layer. This improves diffuser performance and delays the onset of stall.

U.S. Pat. No. 7,251,927 issued on Aug. 7, 2007 to J. H. Anderson, discloses a second stage external jet nozzle mixer that has identically formed lobes which equal in number the lobes of the first stage internal mixer. The external mixer works with the internal mixer and furthers the mixing of the jet engine internal bypass flow with the internal jet engine core flow. This mixing levels the disparate flow velocities attendant with the jet engine exhaust, reduces the peak velocities from the jet engine core and increases the lower bypass velocities of the jet engine internal bypass flow. The lobes include complex curvatures that greatly enhance mixing of the gases and ambient cooling air so as to reduce noise.

It is an object of the present invention to provide an eductor apparatus that provides the ability to control downstream boundary layers and to delay detachment.

It is another object of the present invention to provide an eductor apparatus that enhances the ability to convert the highest possible percentage of kinetic energy into pressure within a given restriction in diffuser lengths and aspect ratio.

It is still a further object of the present invention to provide an eductor apparatus with improved radial velocity in the throat.

It is a further object of the present invention to provide an eductor apparatus that serves to keep the boundary layer thin with respect to the bulk flow field.

It is another object of the present invention to provide an eductor apparatus that minimizes pressure losses in the diffuser.

It is still a further object of the present invention to provide an eductor apparatus that enhances the mixing process.

It is a further object of the present invention to provide an eductor apparatus that produces dynamic stretching and folding so as to cause intense mixing interactions.

It is a further object of the present invention to provide an eductor apparatus that energizes the boundary layer so as to reduce frictional drag so as to cause improved suction.

It is still a further object of the present invention to provide an eductor apparatus with a recessed nozzle that does not obstruct the mixing chamber or allow solids to be accumulated on the exterior surface of the nozzle.

It is still a further object of the present invention to provide an eductor apparatus that allows larger material to be inducted into the mixing process.

It is still a further object of the present invention to provide an eductor apparatus that avoids plugging.

It is still a further object of the present invention to provide an eductor apparatus that effectively mixes and emulsifies.

These and other objects and advantages of the present invention will become apparent from a reading of the attached specification and appended claims.

BRIEF SUMMARY OF THE INVENTION

The present invention is an eductor apparatus that comprises an inlet nozzle section, a mixing chamber, and a diffuser section. The inlet nozzle section has a tubular portion extending to a nozzle. The tubular portion has a primary inlet. The nozzle has a wide diameter opening to the primary inlet of the tubular portion and a narrow diameter opening adjacent an end of the nozzle opposite the wide diameter opening. The mixing chamber is connected to the inlet nozzle section and in fluid communication with the narrow diameter opening of the nozzle. The mixing chamber has an induction port opening thereto and extends therefrom. The diffuser section is connected to the mixing chamber opposite the inlet nozzle section. The diffuser section has a secondary inlet formed therein and opening to the mixing chamber. The secondary inlet narrows in diameter from and mixing chamber. The diffuser section has a throat formed therein adjacent an end of the secondary inlet opposite the mixing chamber. The throat has a plurality of lobes formed thereon. The diffuser section has a diffuser having a narrow diameter opening adjacent the throat and a wide diameter opening at an end of the diffuser opposite the throat.

The plurality of lobes comprise a plurality of ribs extending longitudinally along the throat. The throat has a flow passageway therein. This plurality of lobes extend into the flow passageway. The plurality of lobes are equally circumferentially spaced from each other around the throat. The plurality of lobes comprise between three and twelve lobes. Each of the plurality of lobes has a curved surface facing the flow passageway of the throat.

The narrow diameter opening of the nozzle of the inlet nozzle section has another plurality of lobes formed therearound. This plurality of lobes in the narrow diameter opening of the nozzle is aligned with the plurality of lobes of the throat.

The induction port has an inner wall extending so as to open to the mixing chamber. The end of the nozzle is adjacent the inner wall of the induction port. The end of the nozzle is tapered so as to extend from the inner wall of the induction port outwardly toward the mixing chamber. The mixing chamber may have a secondary suction line opening to the mixing chamber. The secondary suction line is radially spaced from the induction port.

DETAILED DESCRIPTION OF THE INVENTION

Figure 1:
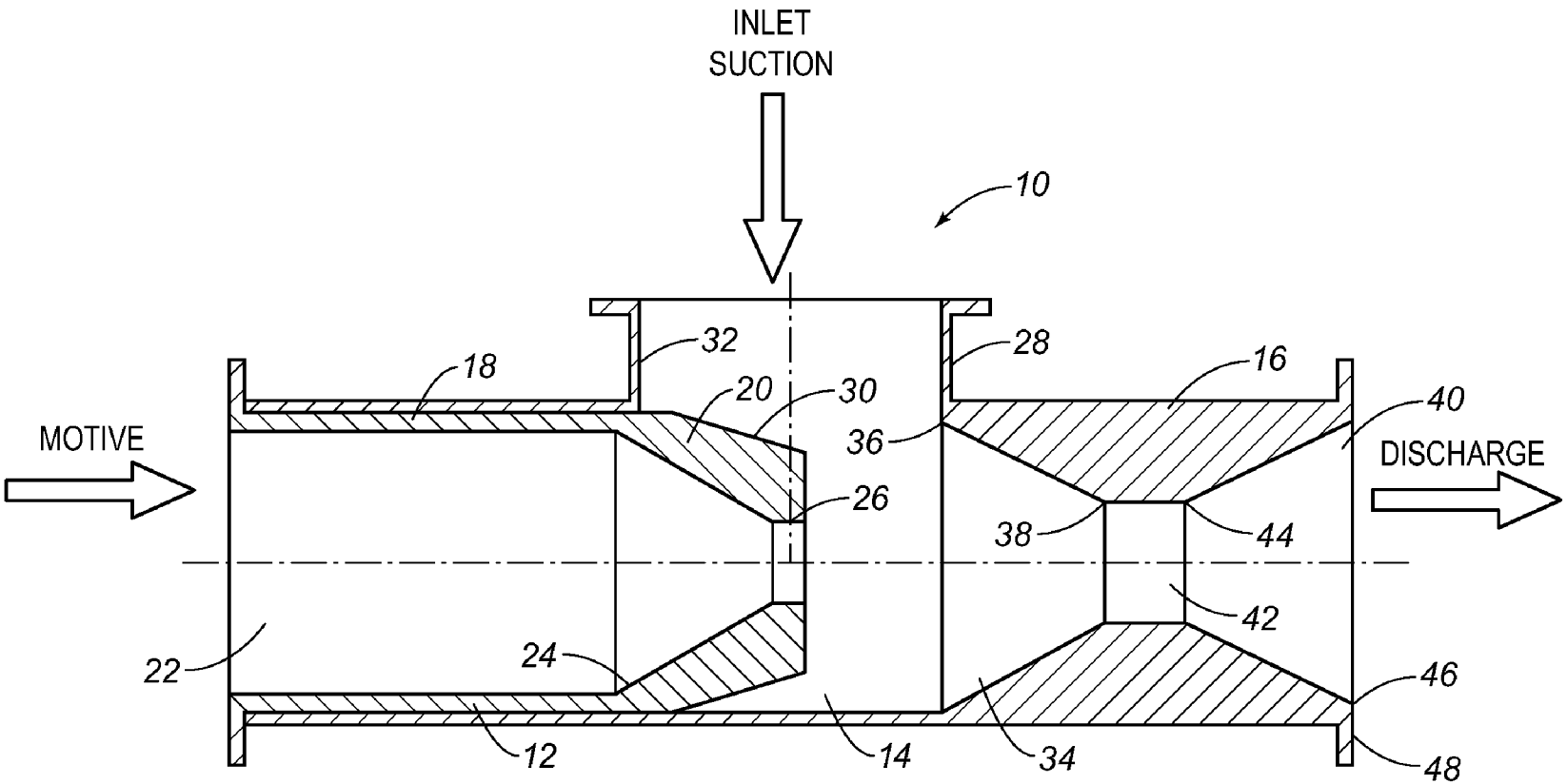
FIG. 1 Prior Art
FIG. 1 is a cross-sectional view of a prior art eductor apparatus.
Figure 2:
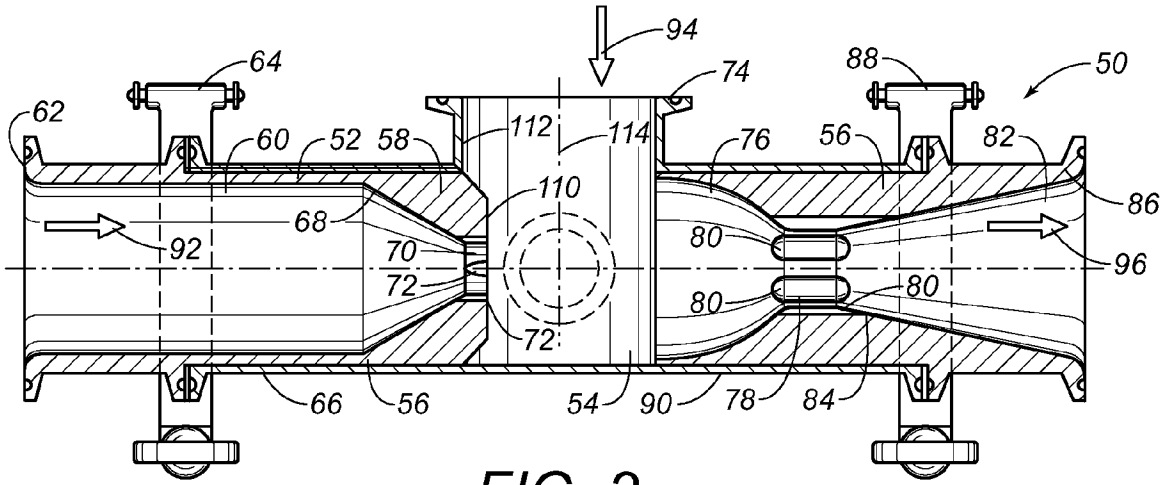
FIG. 2 is a cross-sectional side view of the eductor apparatus in accordance of the preferred embodiment of the present invention.

Referring to FIG. 2, there is shown the eductor apparatus 50 in accordance of the preferred embodiment of the present invention. The eductor apparatus 50 includes an inlet nozzle section 52, a mixing chamber 54 and a diffuser section 56. In particular, the inlet nozzle section 52 has a tubular portion 56 that extends to a nozzle 58. The tubular portion 56 has a primary inlet 60 formed therein. The primary inlet 60 extends from the end 62 of the inlet nozzle section 52 to the nozzle 58. The tubular portion 60 has a generally constant diameter interior passageway. A clamp 64 is utilized so as to join the inlet nozzle section 52 to the mixing chamber 54 through the use of annular member 66.

The nozzle 58 has a wide diameter 68 opening to the primary inlet 60 of the tubular portion 56 and a narrow diameter opening 70 adjacent the end of the nozzle 58 opposite the wide diameter 68. As such, when a liquid is introduced into the primary inlet 60, it will flow into the nozzle 58 such that the narrow diameter 70 will enhance the velocity of the flow of the fluid therethrough.

In FIG. 2, it can be seen that the narrow diameter opening 70 of the nozzle 58 has a plurality of lobes 72 formed therein. These lobes 72 will extend radially inwardly of the narrow diameter opening 70 so as to act on the fluid passing therethrough.

The mixing chamber 54 is connected to the inlet nozzle section 52 and in fluid communication with the narrow diameter opening 70 of the nozzle 58. The mixing chamber 54 has an induction port 74 opening thereto and extending therefrom. As such, the induction port 74 can be used so as to introduce another liquid or particulate solid into the mixing chamber 54 for the purpose of mixing with the fluid flowing through the inlet nozzle section 52.

The diffuser section 56 is connected to the mixing chamber 54 opposite to the inlet nozzle section 52. The diffuser section 56 has a secondary inlet 76 formed therein so as to open to the mixing chamber 54. The secondary inlet 76 is in the nature of a venturi that narrows in diameter from the mixing chamber 54 toward a throat 78. The throat 78 is adjacent to the end of the secondary inlet 76 opposite the mixing chamber 54. It can be seen that the throat 78 has a plurality of lobes 80 formed therein adjacent to the end of the secondary inlet 76 opposite the mixing chamber 54. The diffuser section 56 has a diffuser 82 having a narrow diameter end 84 adjacent to the throat 78 and a wide diameter opening 86 at an end of the diffuser 82 opposite the throat 78. Another clamp 88 secures the diffuser section 56 to a tubular member 90 extending from the mixing chamber 54. As such, the inlet nozzle section 52, the mixing chamber 54 and the diffuser section 56 are joined in end-to-end relationship. Arrows 92, 94 and 96 show the flow of the liquids and solids through the interior of the eductor apparatus 50 so as to provide the proper mixing of these components within the interior of the eductor apparatus 50.

Figure 3:
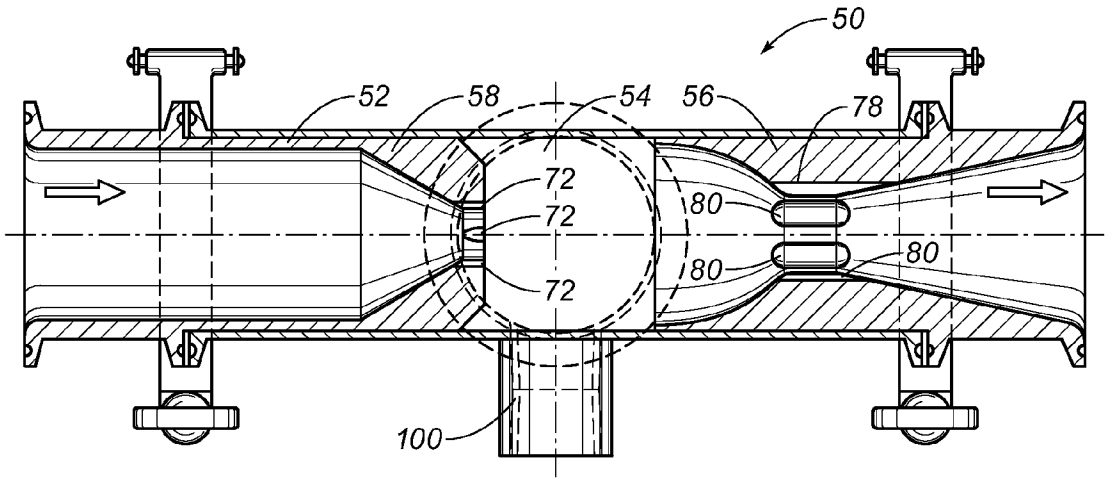
FIG. 3 is a top cross-sectional view of the eductor apparatus of the preferred embodiment of the present invention.

FIG. 3 is a top cross-sectional view of the eductor apparatus 50. In particular, in FIG. 3, it can be seen that there is a secondary suction line 100 that extends from and opens to the mixing chamber 54. As such, if desired, and optionally, another fluid or particulate solid is necessary for introduction into the mixing chamber 54, then the secondary suction line 100 can be utilized so as to provide this input to the interior of the mixing chamber 54.

In FIG. 3, it can be seen that the inlet nozzle section 52 has nozzle 58 with a plurality of lobes 72 formed around the inner wall of the narrow diameter opening 70 of the nozzle 58. Similarly, it can be seen that the throat 78 of the diffuser section 56 has a plurality of lobes 80 formed around an inner wall thereof. So as to enhance the effects of the present invention, the lobes 72 are generally in alignment with the lobes 80.

Figure 4:
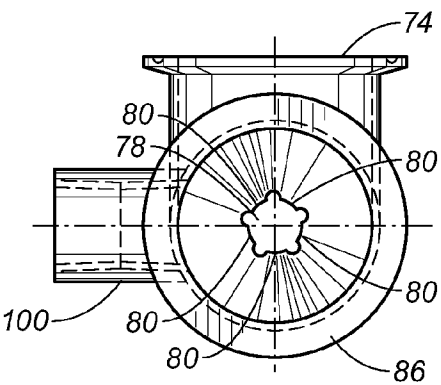
FIG. 4 is an end view of the eductor apparatus of the preferred embodiment of the present invention.

FIG. 4 is an end view as taken from the outlet end 86 of the diffuser section 56. In particular, FIG. 4 illustrates the nature of the lobes 80 that are formed on the inner wall of the throat 78. It can be seen that each of the lobes 80 is in the nature of ribs that extend longitudinally along the throat 78. The lobes 80 extend into the flow passageway defined by the throat 78. The lobes 80 are equally circumferentially spaced from each other around the throat 78. It can be seen in FIG. 4, there are a total of five lobes. However, within the concept of the present invention, the number of lobes can be between three and twelve lobes, depending upon the desired configuration of the eductor apparatus 50 and the diameter of the interior passageways thereof. Each of the lobes 80 is illustrated as having a concave slightly curved surface facing the flow passageway through the throat 78. It should be noted that the lobe 72 on the narrow diameter opening 70 of the nozzle 58 will have a somewhat similar configuration.

FIG. 4 also shows that the induction port 74 extends upwardly from the mixing chamber. Similarly, the optional secondary suction line 100 extends transversely outwardly relative to the induction port 74 in generally radially offset relationship thereto.

The present invention provides significant advantages over the prior art. In particular, the present invention creates a near-perfect vacuum, intense mixing regime, dynamic shearing, downstream boundary layer control and efficient diffuser pressure recovery. When the nozzle 58 of the inlet nozzle section 52 is pressurized from an external energy source, such as a centrifugal or rotary gear pump, the issuing stream exiting the narrow diameter opening 70 of the nozzle 58 will generate an axial (longitudinal) flow pattern. The plurality of lobes 72 will generate a transverse (radial) flow pattern.

The effective and efficient performance of the eductor apparatus 50 is primarily dependent on motive nozzle configuration, the throat cross-sectional ratio to the nozzle orifice area, diffuser length and discharge angle. The non-axisymmetric converging nozzle 58 has a circular inlet 68 converging into a circular core with a plurality of parallel lobes 72. The lobes 72 are uniformly spaced and located around the circumference of the circular core of the narrow opening 70 of the nozzle 58 so as to create a non-circular, axisymmetric exit. The issuing coaxial streams from the nozzle 58 are coherent vortical structures.

An increase in the downstream fluid velocity intensity near the wall of the conduit will keep the boundary layer at the diffuser 82 thin with respect to bulk flow-field. A controlling of the boundary layer thickness will delay wall separation. The scarfing lobes 80 in the throat section 78 will improve the radial velocity. Since the primary purpose of the diffuser 82 is to reduce the velocity and regain pressure, it can serve a multi-purpose task in controlling the downstream boundary layer and minimizing pressure loss. While the throat section 78 of the diffuser section 56 generates a low pressure at the suction inlet and completes the mixing regime of the motive fluid with a secondary additive, the lobes 80 embedded into the internal circumference of the throat section 78 will enhance the mixing process. The throat 78 is generally circular having the ribs (i.e. lobes 80) that are intimately connected, uniformly spaced and located on the circumference of the wall of the throat 78. Since the converging lobes of the nozzle 58 are perfectly aligned with the lobes 80 of the throat 78, the lobe orientation will be generally parallel to the flow-field. Maximum pressure recovery typically occurs for diffuser geometries when the wall boundary layer is very close to detachment at the exit 86 of the diffuser 82.

The inlet to the throat 78 is curvilinear (i.e. parabolic) in shape. This provides a larger cross-sectional are for a two-component mixing before the bulk fluid mixture is drawn into the throat 78 of the final stage of mixing before the bulk fluid exits the diffuser 82.

A significant increase in the efficiency of the diffuser section 56 occurs by installing the lobes 80 in the throat 78. The diffuser lobes 80 in the throat 78 produce dynamic stretching and folding so as to cause intense mixing interaction between the motive fluid and the secondary additive. The velocity increases in the throat 78 as it enters the lobes 80 so as to provide a smooth transition, in the direction of flow. The flow-field is sub-divided into multiple streams as the flow-field passes through the throat 78 so as to produce vortice structures that energize the boundary layers near the wall of the diffuser 80. This energized boundary layer reduces the frictional drag and results in a near-perfect suction. The throat 78 dictates the strength of the suction.

The select geometry in relation to depth and width ratio of the lobes 80 of the diffuser section 56 is critical in providing the optimum mixing performance. The lobe geometry in the throat 78 increases the interfacial mixing area so as to generate intense cross-flow vortices leading to an array of intense turbulent structures along the conduit wall so as to reduce the frictional or viscous drag.

In the present invention, it should be noted that the nozzle 58, as shown in FIG. 2, has an end 110 that tapers toward the inner wall 112 of the induction port 74. The ends of the nozzle 58 are recessed away from the center line 114 of the induction port 74 and the mixing chamber 54. As such, the nozzle 58 is recessed so as to avoid any obstruction in the mixing chamber 54. As a result, larger diameter material can be inducted through the induction port 74. In addition to the induction of larger particles and pellet sizes, this recessed nozzle 58 provides a clear passage for powders to be mixed without plugging. Generally, most conventional eductor apparatus have a motive nozzle that protrudes more than half of the way into the mixing chamber 54. This is disadvantage because when dosing a powder, such as a polymer or bentonite through a feed hoper, a portion of the powder accumulates on the top of the protruding nozzle and is not drawn into the jet stream of the issuing flow stream. Eventually, the build-up of powder on the nozzle can get wet and gummy. This ultimately cause a blockage to the throat 78. This could cause a disruption of the constant feed rate and not be able to accommodate large particles introduced through the induction port 74. However, by recessing the end 110 of the nozzle 58 so as to be in a position adjacent to an inner wall 112 of the induction port 74, this accumulation of powder is avoided. Additionally, a relatively wide area is provided whereby large particles can be introduced through the opening of the induction port 74 and into the mixing chamber 54. The end 110 of the nozzle 58 will not interfere with the introduction of such large particles.

In the present invention, the eductor apparatus 50 with a non-axisymmetric converging nozzle and a downstream symmetrically aligned non-axisymmetric venturi throat serves to reduce viscous or frictional drag on the hydrodynamic body or conical diffuser 82 in the eductor apparatus 50. The present invention is also a passive method of manipulating and controlling the hydrodynamic flow-field in a conduit with a particle-laden slurry. A thin layer of fluid exists between the stationary surface and a moving flowstream interface. This layer is known as a "boundary layer". The present invention provides a passive method of reducing this boundary layer at the interactive surface of the conduit. The reduction of the thickness of the boundary layer provides a near-perfect vacuum or low pressure region at the suction inlet of the eductor apparatus. In addition to the high vacuum produced at the eductor suction, the radial vortices will promote a high velocity flow stream along the downstream conduit so as to cause intimate mixing and long distance product delivery.

The present invention improves the diffuser performance by passively controlling the boundary layer of the downstream bulk flow-field. The throat 78 employs scarfed lobes 80 in the direction of flow so as to as to generate well-organized distribution of vorticity. The diffuser section 56 generates large scale and small scale vortices. The issuing vortice structures rotate in opposite directions as they exit the throat 78 and travel longitudinally in the flow direction. The spinning vortices energize the boundary layer near the wall of the diffuser 82 as the portion of the flow-field is drawn into the bulk flow. The strong vortice structures that prevent early boundary layer detachment will permit a shorter diffuser section if installed in a constricted area. The efficient pressure recovery of approximately 72% of the motive pressure is significantly greater than the pressure recovery of most conventional eductor apparatus. These conventional eductor apparatus claim pressure recovery in the range of 38 to 42%. The substantial improvement in pressure recovery provides a platform for rapid additive mixing with the motive fluid and longer distance delivery. The positive effects of vortical structures on the wall shear stress and the turbulent characteristics of the downstream boundary layer in the diffuser section 58 of the Applicant's eductor 50 generates a near-perfect vacuum at the suction and a 72% pressure recovery. This allows for rapid mixing powders with liquids and long distance delivery. As such, the eductor apparatus of the present invention effectively mixes, dissolves and disperses a powder, granular material and/or crystals. The eductor apparatus 50 also effectively and efficiently uniformly mixes one or more liquids with a liquid. The eductor apparatus 50 of the present invention further effectively mixes and emulsifies an oil and water.

The foregoing disclosure and description of the invention is illustrative and explanatory thereof. Various changes in the details of the illustrated construction can be made within the scope of the appended claims without departing from the true spirit of the invention. The present invention should only be limited by the following claims and their legal equivalents.

I claim:

1. An eductor apparatus comprising:

an inlet nozzle section having a tubular portion extending to a nozzle, said tubular portion having a primary inlet formed therein, said nozzle having a wide diameter opening to said primary inlet of said tubular portion and a narrow diameter opening adjacent an end of said nozzle opposite said wide diameter opening;

a mixing chamber connected to said inlet nozzle section and in fluid communication with said narrow diameter opening of said nozzle, said mixing chamber having an induction port opening thereto and extending therefrom;

a diffuser section connected to said mixing chamber opposite said inlet nozzle section, said diffuser section having a secondary inlet formed therein and opening to said mixing chamber, said secondary inlet narrowing in diameter from said mixing chamber, said diffuser section having a throat formed therein adjacent an end of said secondary inlet opposite said mixing chamber, said throat having a plurality of lobes formed thereon, said diffuser section having a diffuser having a narrow diameter opening adjacent said throat and a wide diameter opening at an end of and diffuser opposite said throat, each of said plurality of lobes having a concave curved surface facing said flow passageway, said throat having a flow passageway therein, said plurality of lobes extending into said flow passageway.

2. The eductor apparatus of claim 1, said plurality of lobes comprising a plurality of ribs extending longitudinal along said throat.

3. The eductor apparatus of claim 1, said plurality of lobes being equally circumferentially spaced from each other around said throat.

4. The eductor apparatus of claim 1, said plurality of lobes comprising between three and twelve lobes.

5. The eductor apparatus of claim 1, said narrow diameter opening of said nozzle of said inlet nozzle section having another plurality of lobes formed therearound.

6. The eductor apparatus of claim 5, said another plurality of lobes being aligned with said plurality of lobes said throat.

7. The eductor apparatus of claim 1, said induction port having an inner wall extending so as to open to said mixing chamber, said end of said nozzle being adjacent said inner wall of said induction port.

8. The eductor apparatus of claim 7, said end of said nozzle being tapered so as to extend from said inner wall of said induction port outwardly toward said mixing chamber.

9. The eductor apparatus of claim 1, said mixing chamber having a secondary suction line opening to said mixing chamber, said second suction line being radially spaced from said induction port.

10. An eductor apparatus comprising:

an inlet nozzle section having a tubular portion extending to a nozzle, said tubular portion having a primary inlet, said nozzle having a wide diameter opening to said primary inlet of said tubular portion and a narrow diameter opening adjacent an end of said nozzle opposite said wide diameter opening, said inlet nozzle section having a non-tapering section extending from said narrow diameter opening, said non-tapering section of said inlet nozzle section having a first plurality of lobes formed therearound;

a mixing chamber connected to said inlet nozzle section and in fluid communication with said narrow diameter opening of said nozzle, said mixing chamber having an induction port opening thereto and extending therefrom; and a diffuser section connected to said mixing chamber opposite said inlet nozzle section, said diffuser section having a secondary inlet formed therein and opening to said mixing chamber, said secondary inlet narrowing in diameter from said mixing chamber, said diffuser section having a throat formed therein adjacent an end of said secondary inlet opposite said mixing chamber, said throat having a second plurality of lobes formed thereon, said diffuser section having a diffuser having a narrow diameter opening adjacent said throat and a wide diameter opening at an end of and diffuser opposite said throat.

11. The eductor apparatus of claim 10, said first plurality of lobes being longitudinally aligned with said second plurality of lobes.

12. The eductor apparatus of claim 10, said first plurality of lobes being of an equal number of lobes as the number of lobes of said second plurality of lobes.

13. The eductor apparatus of claim 10, said second plurality of lobes comprising a plurality of ribs extending longitudinally along said throat.

14. The eductor apparatus of claim 10, said first plurality of lobes being equally circumferentially spaced from each other around said narrow diameter opening of said nozzle, said second plurality of lobes being equally circumferentially spaced from each other around said throat.

15. The eductor apparatus of claim 10, said first plurality of lobes comprising between three and twelve lobes, said second plurality of lobes comprising between three and twelve lobes.

16. The eductor apparatus of claim 10, said induction port having an inner wall extending so as to open to said mixing chamber, said end of said nozzle being adjacent said inner wall of said induction port.

* * * * *